United States Patent [19]

Malloy

[11] 4,433,737

[45] Feb. 28, 1984

[54] WATER JET SEDIMENT PROBE

[75] Inventor: Richard J. Malloy, Ojai, Calif.

[73] Assignee: The United States of America as represented by the Secretary of the Navy, Washington, D.C.

[21] Appl. No.: 361,713

[22] Filed: Mar. 25, 1982

[51] Int. Cl.[3] ..... E21B 7/18

[52] U.S. Cl. ..... 175/5; 175/67; 73/84; 138/103

[58] Field of Search ..... 175/5, 67, 103, 422; 173/DIG. 2; 73/84, 85, 170; 405/248; 138/103, 110, 120, 155, 172; 299/17

[56] References Cited

U.S. PATENT DOCUMENTS

| | | | |
|---|---|---|---|
| 1,609,818 | 12/1926 | Heydon | 138/157 |
| 1,994,884 | 3/1935 | Chew | 175/67 X |
| 2,028,580 | 1/1936 | Yedd | 175/67 |
| 2,769,999 | 11/1956 | Sheahan | 15/327 |
| 3,030,086 | 4/1962 | Donaldson et al. | 299/17 X |
| 3,148,538 | 9/1964 | Heerema | 73/84 |
| 3,179,442 | 4/1965 | Lofgren | 138/110 |
| 3,385,130 | 5/1968 | Boice | 175/61 |
| 3,446,297 | 5/1969 | Cullen et al. | 175/320 |
| 3,730,228 | 5/1973 | Gibbs, Sr. | 138/106 |
| 4,168,752 | 9/1979 | Sabol | 175/67 X |
| 4,178,949 | 12/1979 | Mazon | 138/110 X |
| 4,228,978 | 10/1980 | Rand | 138/106 X |

*Primary Examiner*—Ernest R. Purser
*Assistant Examiner*—Thuy M. Bui
*Attorney, Agent, or Firm*—Robert F. Beers; Joseph M. St. Amand

[57] ABSTRACT

Various means for providing rigidity to the flexible hose of a water jet sediment probe that is used to determine thickness and types of underlying sediment beneath land or seafloor is disclosed. A series of interconnecting rods or pipe sections are used to stiffen a length of flexible hose to a desired probe depth to enable a single operator to bore a hole of indefinite depth without assistance.

8 Claims, 4 Drawing Figures

WATER JET SEDIMENT PROBE

BACKGROUND OF THE INVENTION

This invention relates to soil probes and particularly to a water jet sediment probe to determine, for example, the thickness of sand and other sediments on a beach overlying bedrock or the depth and type of sediment beneath a seafloor, etc.

Frequently, it is necessary to determine the depth of sand or various types of sediment on a beach or the seafloor in the vicinity of a beach for purposes of installing piles or other devices in the construction of piers and causeways and other structures. Also, it may be desirable to know the types and depths of sediment on a seafloor prior to installation of propellant embedded anchors and the like. An experienced operator while spudding a probe pipe into sediment can estimate the types of sediment being penetrated by feeling the vibrations transmitted from the lower tip of the probe pipe as it passes through the sediment layers.

A sediment probe using a water jet, also known as a wash pipe, generally consists of a rigid length of metal pipe, a flexible hose, and a source of water under pressure (from a water pump), Water being expelled under pressure from the end of the metal pipe or a jet nozzle at the end of the metal pipe operates to displace sediment or soil as it is being spudded (i.e., pushed) into the sediment by an operator. Soil is liquified at the point of entry and remains liquified ("quick") as long as water is continued to be pumped into the hole from the probe. The length of the metal pipe is limited by the operator's strength and height. A ten foot length of pipe is about the maximum practical limit for one person to work with and handle without assistance. A twenty-foot length of pipe can be used if guy lines are used to hold the pipe vertical, but such lengths require at least three guy line tenders in addition to the operator (spudder). Also, it is impossible to bore a deep hole using several sections of short pipe connected one at a time, because when water circulation is interrupted to make a pipe connection the sand, gravel, pebbles and rocks in the loose sediment will resettle and block water circulation when the pump is restarted, thus preventing further penetration. In addition, the resettled sediments may prevent or make it difficult to remove the pipe from the hole. No simple and satisfactory prior system has been found whereby one person working alone can bore a deep hole, such as 30 feet or deeper, due to the difficulty for the spudder to handle a probe pipe over 10 feet in length.

SUMMARY OF THE INVENTION

It is an object of the invention, therefore, to provide a water jet sediment probe system whereby one person can bore deep holes exceeding ten feet in depth.

The sediment probe of this invention provides means for making a flexible hose rigid, one portion at a time, so that it can be spudded into the sediment without the need to start with one rigid piece of pipe that is as long as the desired hole depth. A flexible hose is attached to an initial length of pipe which includes the probe tip and a pumping means is provided to pump water under pressure through the flexible hose and out through the probe tip. A series of short rigid rod or pipe sections are attached adjacent to or about the flexible hose at regular intervals as it is spudded into the sediment to provide the required rigidity along the entire length of the probe until the desired hole depth is reached. This system permits one person handling only short sections of rod, pipe, or split pipe to probe or jet-in a hole of indefinite depth without having to raise and use a rigid pipe as long as the desired depth of the hole. The system is operable for use on land or by divers underwater.

DESCRIPTION OF THE PREFERRED EMBODIMENTS

Figure 1:
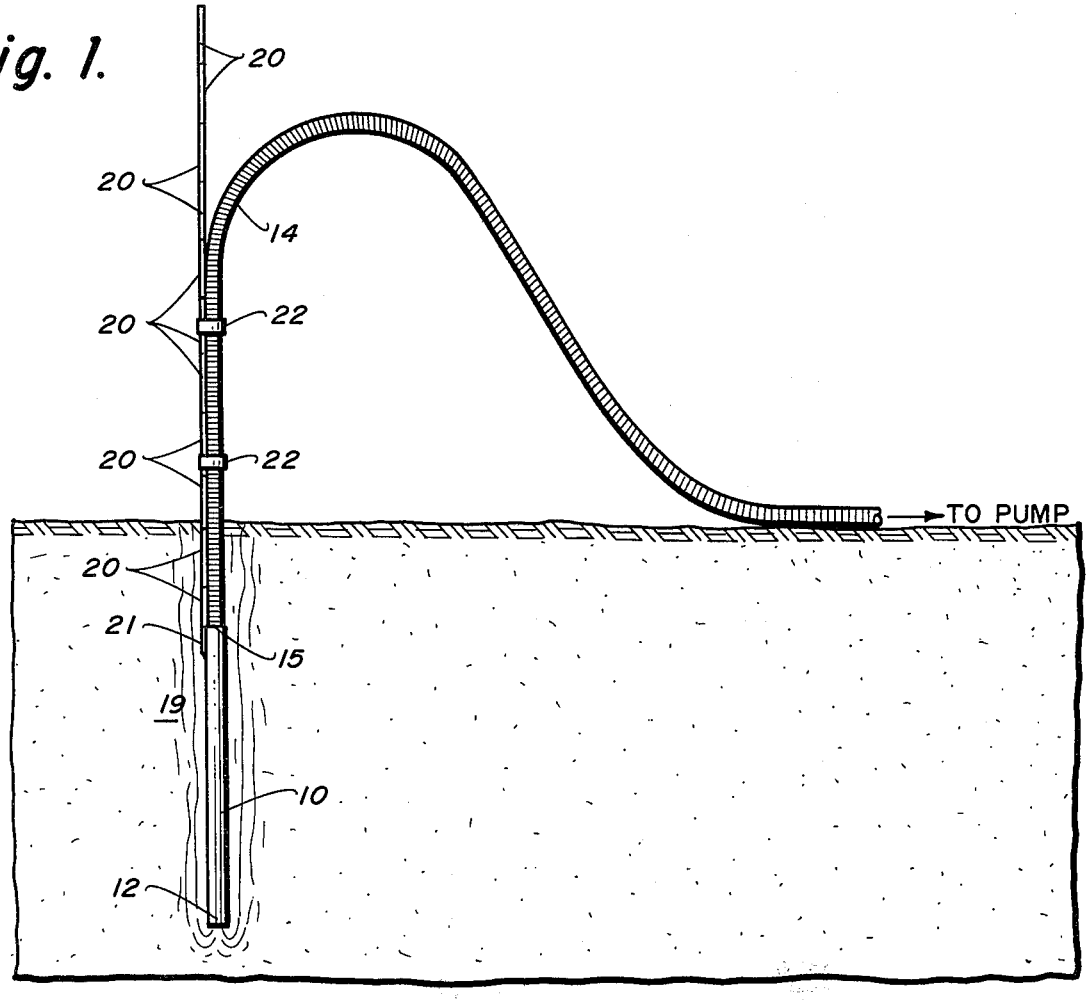
FIG. 1 shows an embodiment of the invention using a series of interconnected short sections of rod to stiffen the flexible hose of a water jet sediment probe to a desired depth.
Figure 4:
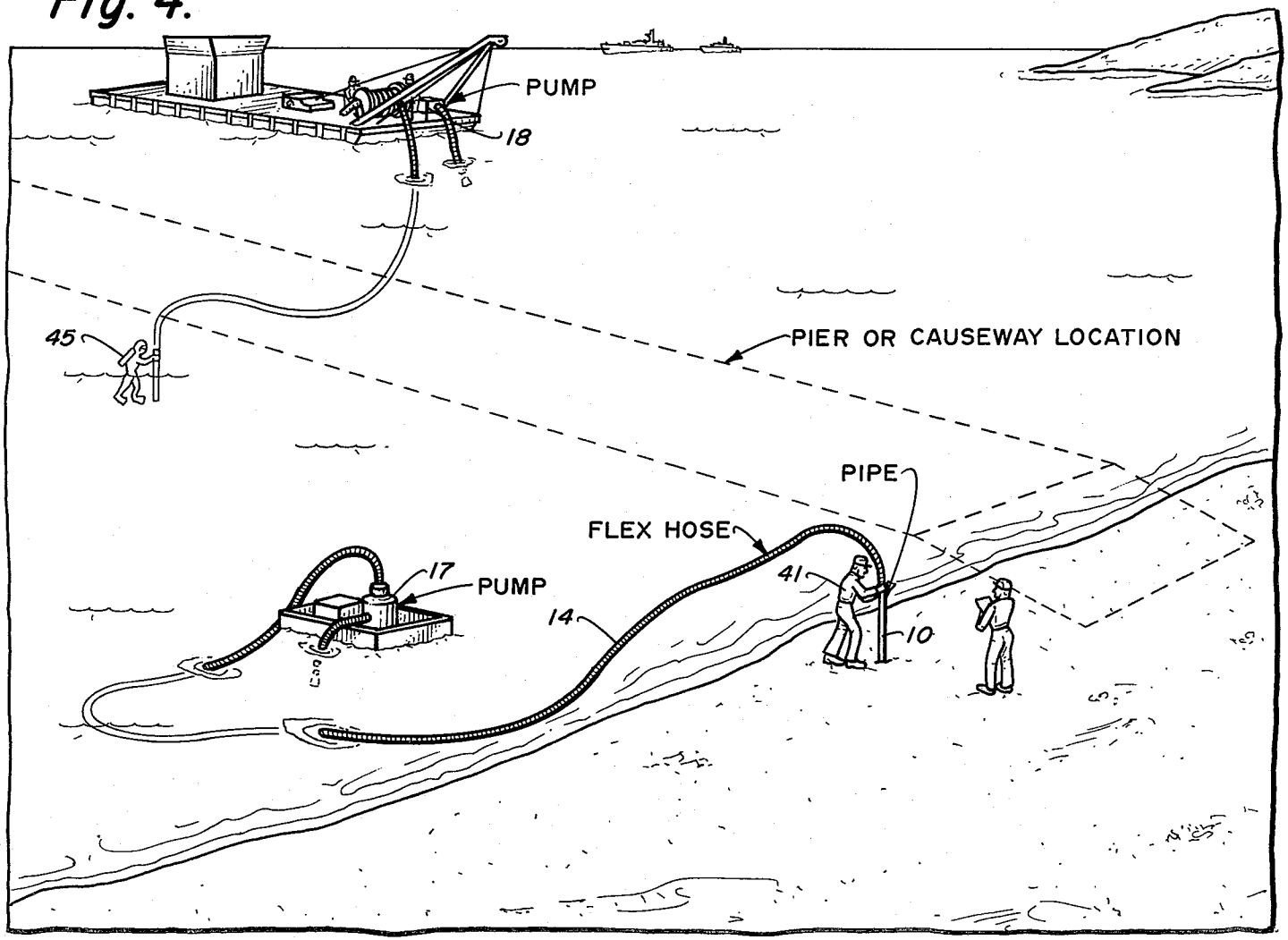
FIG. 4 is an illustration showing use of the present invention on shore and underwater.

The embodiment shown in FIG. 1 shows an initial length of rigid metal pipe 10, for example, which can include a jet nozzle at its lower tip 12, if desired. One end of a flexible hose 14, of any desirable length, is connected to the upper end 15 of rigid pipe 10, the other end of hose 14 is connected to a source of water under pressure, such as a pump 17 or 18, as shown in the illustration of FIG. 4. Soil or sediment 19 is liquified at the point of entry, as water is jetted from tip 12 of the probe and it remains liquified (i.e., quick) as long as water is continued to be pumped into the hole from the probe 10.

As probe 10 is spudded into the sediment it is necessary that hose 14 be made rigid in order that the probe can continue to be pushed into the sediment or soil to bore a hole of desired depth. Rigidity is supplied to the desired depth by a series of short rigid metal rods 20 which are connected together in any convenient manner, such as by threaded couplings for example, and to an attachment means 21 at the upper end 15 of probe 10. Clamps or straps 22 fasten the flexible hose 14 to the interconnected rods 20 at regular intervals. This is one manner of making the flexible hose rigid so that it can be spudded into the sediment.

Figure 2:
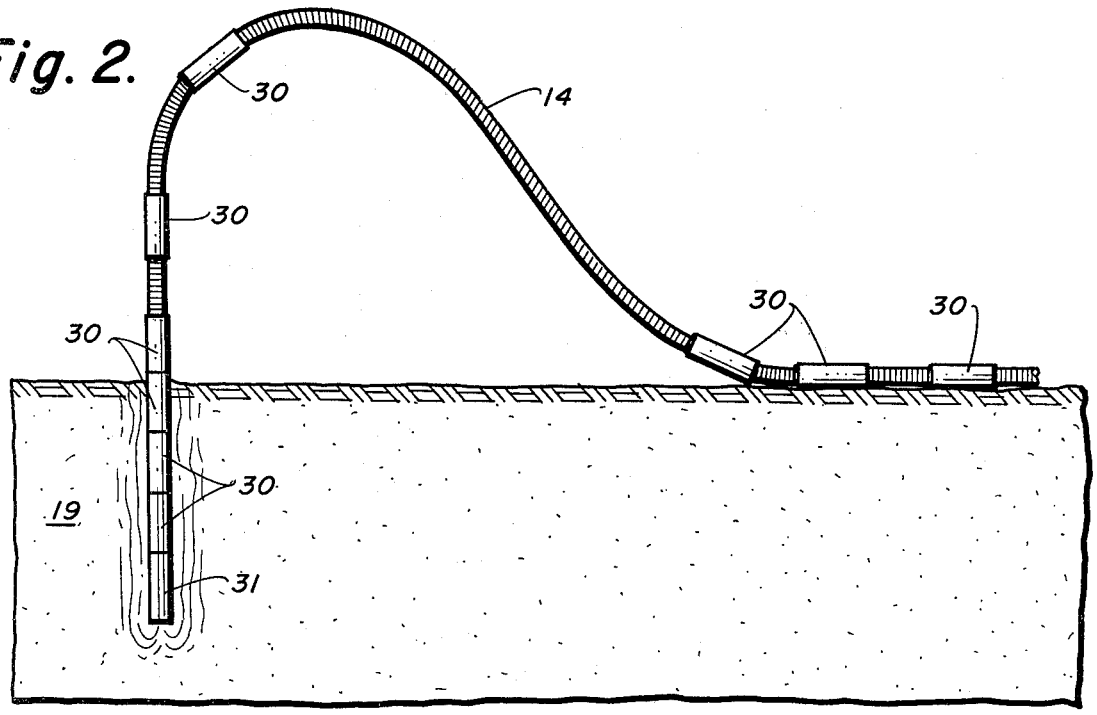
FIG. 2 is another embodiment of the invention using interconnected pipe sections on the flexible hose to provide the desired rigidity.

Another means for providing rigidity to flexible hose 14 is illustrated in FIG. 2 where a series of short sections of threaded pipe 30 are slipped onto and stored on the flexible hose. The pipe sections 30 are slid along the hose as needed and screwed into the top of the previous section as the probe end 31 and each added section 30 is spudded into the sediment, until the desired depth is reached.

Figure 3:
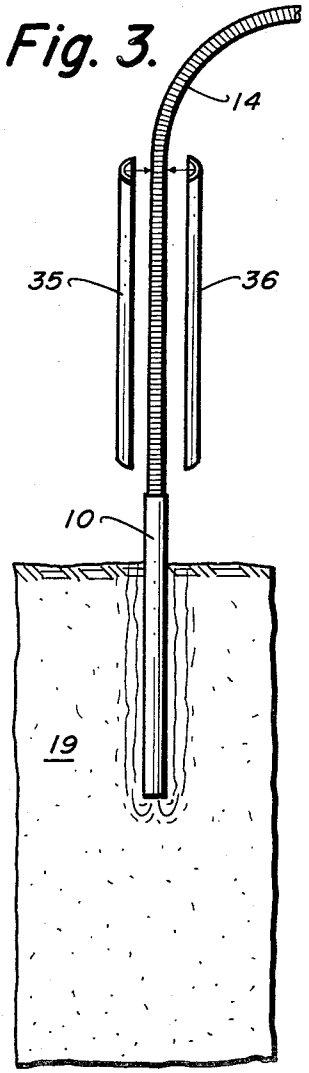
FIG. 3 shows an embodiment similar to that of FIG. 2, but using split sections of pipe.

FIG. 3 shows the addition of sections of split pipe to provide rigidity of flexible hose 14. In this embodiment, each section of pipe consists of two halves, 35 and 36, which are assembled by any suitable means and applied about hose 14. Each assembled section 35, 36 is then connected to the next preceeding section in a similar manner to that shown in FIG. 2 to provide rigidity as the probe is spudded into the sediment to the desired depth.

In each case, retrieval of the probes is accomplished by reversing the process and removing the sections of rod or pipe as the probe is raised from the hole, while continuing to pump water through the system.

With the system described above a hole of indefinite depth can be jetted by one person handling only short (e.g., 5 foot) sections of rod, pipe or split pipe. The system can be used on land or underwater as illustrated by way of example in FIG. 4. As shown in FIG. 4, a single operator 41 on shore is spudding a pipe probe into the sand on the beach. Flex hose 14 is connected from pump 17 to probe pipe 10. The various means for providing rigidity to the flex hose, as already described, will permit the probing of the soil or sediment to a desired depth without the need to use a single rigid pipe, guy lines or guy line tenders. This same system is operable on the seafloor by a diver 45 on the seafloor operating a water jet sediment probe connected by flexible hose to a water pump 18 on a barge, for example.

Any material can be used to provide rigidity to the flexible hose, but where the operator wants to sense what kind of sediment the lower tip of the probe is penetrating by feeling the vibrations transmitted from the pipe lower tip, a stiffener material that is a good conductor of vibrations caused by spudding through the sediment is needed.

This can permit an experienced operator to sense various types of sediment layers, such as sand, clay, gravel or pebbles, rocks, and the like.

Although the jet probe can be used on the seafloor, as discussed and shown in FIG. 4, the logistic problems presented by the pump (and driving engine) and hose become more bothersome. In areas of strong currents (e.g., greater than 1 knot) the forces acting on the hose which must extend from the seafloor to the surface become preventative. Even in relatively quiet current areas (e.g., less than ½ knot) 100 feet is the practical limit of the hose for conducting jet probe investigations.

In such underwater operations a battery driven water pump can be used on the seafloor at the end of the flexible hose, and the embodiment shown in FIG. 1 used to probe the seafloor sediment.

Obviously many modifications and variations of the present invention are possible in the light of the above teachings. It is therefore to be understood that within the scope of the appended claims the invention may be practiced otherwise than as specifically described.

What is claimed is:

1. A water jet sediment probe system, operable to be spudded into sediment by a single person without assistance for jetting straight holes of indefinite depth, comprising:

a. a source of water under pressure, b. a probe means, c. a flexible hose having one end thereof connected to said source of water and the other end connected to said probe means, d. said probe means consisting substantially of a short rigid length of pipe having a jet end and a connector end; said connector end being connected to the other end of said flexible hose wherein water under pressure from said source passes through said flexible hose and is jetted from the jet end of said probe means for liquifying sediment;

e. a hose stiffening means connected to said probe means and comprising a plurality of rigid sectional means operable to be connected together section by section in series and in straight alignment for increasing the rigid length thereof as desired from the connector end of said probe means; said hose stiffening means additively holding consecutive portions of said flexible hose in a rigid manner and in straight alignment with said probe means to permit said probe means together with a desired rigidized length of said flexible hose to be spudded into sediment by liquification thereof to a desired depth without necessitating the interruption of water flow through said flexible hose and said probe means.

2. A sediment probe system as in claim 1 wherein said probe means and said hose stiffening means is constructed from material which is a good conductor of vibrations caused by spudding through various types of sediment thereby permitting the sensing of various types of sediment layers by means of sensing different vibrations through said material.

3. A sediment probe system as in claim 1 wherein said plurality of rigid sectional means comprises a series of rods which are interconnected to each other from the connector end of said probe means to form an extended rod along a desired portion of said flexible hose; said rods including means to fasten said flexible hose thereto at regular intervals.

4. A sediment probe system as in claim 1 wherein said plurality of rigid sectional means comprises a series of short sections of pipe slideably stored on said flexible hose; each of said pipe sections being operable to be slid along said flexible hose and connected to the end of a previous section as needed until said probe means is spudded to the desired depth.

5. A sediment probe system as in claim 1 wherein said plurality of rigid sectional means comprises a plurality of split pipe sections which are clamped about said flexible hose in series.

6. A sediment probe system as in claim 1 wherein a pump means is used to provide said source of water under pressure.

7. A sediment probe system as in claim 1 wherein said probe means is operable to be retrieved from the distance spudded into the sediment by disconnecting said plurality of rigid sectional means section by section as the probe is raised from the sediment.

8. A sediment probe system as in claim 1 wherein the sediment being probed is at and beneath the seafloor and said flexible hose extends from said probe means at the seafloor to a floating platform on the surface of the sea where a pump means provides said source of water under pressure.

* * * * *